US007993501B2

(12) United States Patent
Ashford et al.

(10) Patent No.: US 7,993,501 B2
(45) Date of Patent: Aug. 9, 2011

(54) DOUBLE CONTACT BAR INSULATOR ASSEMBLY FOR ELECTROWINNING OF A METAL AND METHODS OF USE THEREOF

(75) Inventors: Bret Ashford, Silver City, NM (US); William A Ebert, Tucson, AZ (US); Fernando D Mollo Vega, Iquique (CL); Samuel Rasmussen, Sheridan, WY (US); Timothy G Robinson, Scottsdale, AZ (US); Scot P Sandoval, Morenci, AZ (US)

(73) Assignee: Freeport-McMoran Corporation, Phoenix, AZ (US)

( * ) Notice: Subject to any disclaimer, the term of this patent is extended or adjusted under 35 U.S.C. 154(b) by 314 days.

(21) Appl. No.: 12/265,992

(22) Filed: Nov. 6, 2008

(65) Prior Publication Data

US 2009/0152124 A1 Jun. 18, 2009

Related U.S. Application Data

(60) Provisional application No. 60/986,211, filed on Nov. 7, 2007.

(51) Int. Cl.

| | |
|---|---|
| ***C25B 9/02*** | (2006.01) |
| ***C25B 9/04*** | (2006.01) |
| ***C25C 1/12*** | (2006.01) |
| ***C25C 1/16*** | (2006.01) |
| ***C25D 17/06*** | (2006.01) |

(52) U.S. Cl. ..... 204/267; 204/278.5; 204/286.1; 204/297.01; 204/228.1; 204/230.2; 204/279; 204/232; 204/242; 205/574; 205/602

(58) Field of Classification Search ..... 204/279, 204/281, 286.1, 297.01, 267, 278.5, 242, 204/232, 228.1, 230.2; 205/574, 602
See application file for complete search history.

(56) References Cited

U.S. PATENT DOCUMENTS

| | | | | |
|---|---|---|---|---|
| 315,265 | A | 4/1885 | Farmer | |
| 789,353 | A | 5/1905 | Betts | |
| 1,095,748 | A | 5/1914 | Thum | |
| 1,501,692 | A | 7/1924 | Ward | |
| 3,579,431 | A | 5/1971 | Jasberg | |
| 3,697,404 | A | 10/1972 | Paige | |
| 3,929,614 | A * | 12/1975 | Hidohira | 204/242 |
| 4,035,280 | A | 7/1977 | Deane et al. | |
| 4,213,842 | A | 7/1980 | Dufresne | |

(Continued)

FOREIGN PATENT DOCUMENTS

DE 19940698 3/2001

OTHER PUBLICATIONS

ISR and Written Opinion from corresponding International App. No. PCT/US2008/082754 dated Feb. 27, 2009.

*Primary Examiner* — Bruce F Bell
(74) *Attorney, Agent, or Firm* — Snell & Wilmer L.L.P.

(57) ABSTRACT

In various embodiments, the present invention provides an electrolytic cell contact bar having a first pole and a pair of second poles. The second poles are opposite in charge to the first pole and each of the pair of second poles are adjacent to and parallel to the first pole. In various embodiments, the contact bar may include an electrode holder capable of holding at least one electrode.

20 Claims, 11 Drawing Sheets

U.S. PATENT DOCUMENTS 5,645,701 A * 7/1997 Dufresne et al. ..... 204/297.01
5,762,767 A 6/1998 Yamada et al.
6,045,669 A * 4/2000 Matsumoto et al. ..... 204/297.01
6,342,136 B1 * 1/2002 Virtanen et al. ..... 204/242
6,872,288 B2 3/2005 Huens et al.
6,972,107 B2 12/2005 Marsden et al.
7,204,919 B2 4/2007 Dufresne
7,223,324 B2 * 5/2007 Dufresne ..... 204/279
7,232,324 B2 6/2007 Oesterhaus
7,597,786 B2 * 10/2009 Kivisto et al. ..... 204/286.1
2005/0121319 A1 6/2005 Dufresne
2009/0139857 A1 * 6/2009 Ebert ..... 204/297.01

* cited by examiner

DOUBLE CONTACT BAR INSULATOR ASSEMBLY FOR ELECTROWINNING OF A METAL AND METHODS OF USE THEREOF

CROSS REFERENCE TO RELATED APPLICATIONS

This application claims priority to U.S. Provisional Patent Application, Ser. No. 60/986,211 entitled "Double Contact Bar Insulator Assembly for Electrowinning of a Metal and Methods of Use Thereof" filed on Nov. 7, 2007, which is incorporated by reference herein.

FIELD OF THE INVENTION

The present invention relates generally to electrolytic cells and more specifically to contact bars that provide a current to the electrodes of an electrolytic cell. More particularly, the present invention relates to electrolytic cells and electrolytic cell systems for recovering copper and other metal values from metal bearing solutions.

BACKGROUND

Electrowinning is a well-known process for refining a desired metal. Typically, the electrowinning is accomplished in an electrolytic cell which contains the desired metal ion in a solution. A cathode and an anode are immersed in the solution. When a current is passed through the electrolytic cell, the desired metal is plated onto the cathode. The commercial use of electrowinning requires a large amount of cathodes and anodes in a single cell. In general, the cathodes and anodes are hung from the sides of the walls of the electrolytic cell. Current is provided to the cathodes and anodes through a series of contact bars that are on the top of the walls. An electrowinning system can include a series of interconnected electrolytic cells that may populate an entire floor of a refining facility. In such electrowinning systems, the contact bars can be very complex and can have shortcomings in the efficiency and consistency of the current flow. Improvements are needed to electrowinning systems and the contact bars which are a part of said systems.

Further areas of applicability will become apparent from the description provided herein. It should be understood that the description and specific examples are intended for purposes of illustration only and are not intended to limit the scope of the present invention.

SUMMARY OF THE INVENTION

Accordingly, in various embodiments, the present invention provides an electrolytic cell contact bar having a first pole and a pair of second poles. The second poles are opposite in charge to the first pole and each of the pair of second poles are adjacent to and parallel to the first pole. In various embodiments, the contact bar supports the extremities of the plurality of electrodes immersed into two different electrolytic cells and provides current to the cathodes and anodes in the two cells. In an exemplary embodiment, the first pole is coupled to at least one cathode and one of the second poles is coupled to at least one anode. In an alternative exemplary embodiment, the first pole is coupled to at least one anode and one of the second poles is coupled to at least one cathode.

BRIEF DESCRIPTION OF THE DRAWINGS

The drawings described herein are for illustration purposes only and are not intended to limit the scope of the present disclosure in any way. The present invention will become more fully understood from the detailed description and the accompanying drawings wherein.

DETAILED DESCRIPTION

Figure 1:
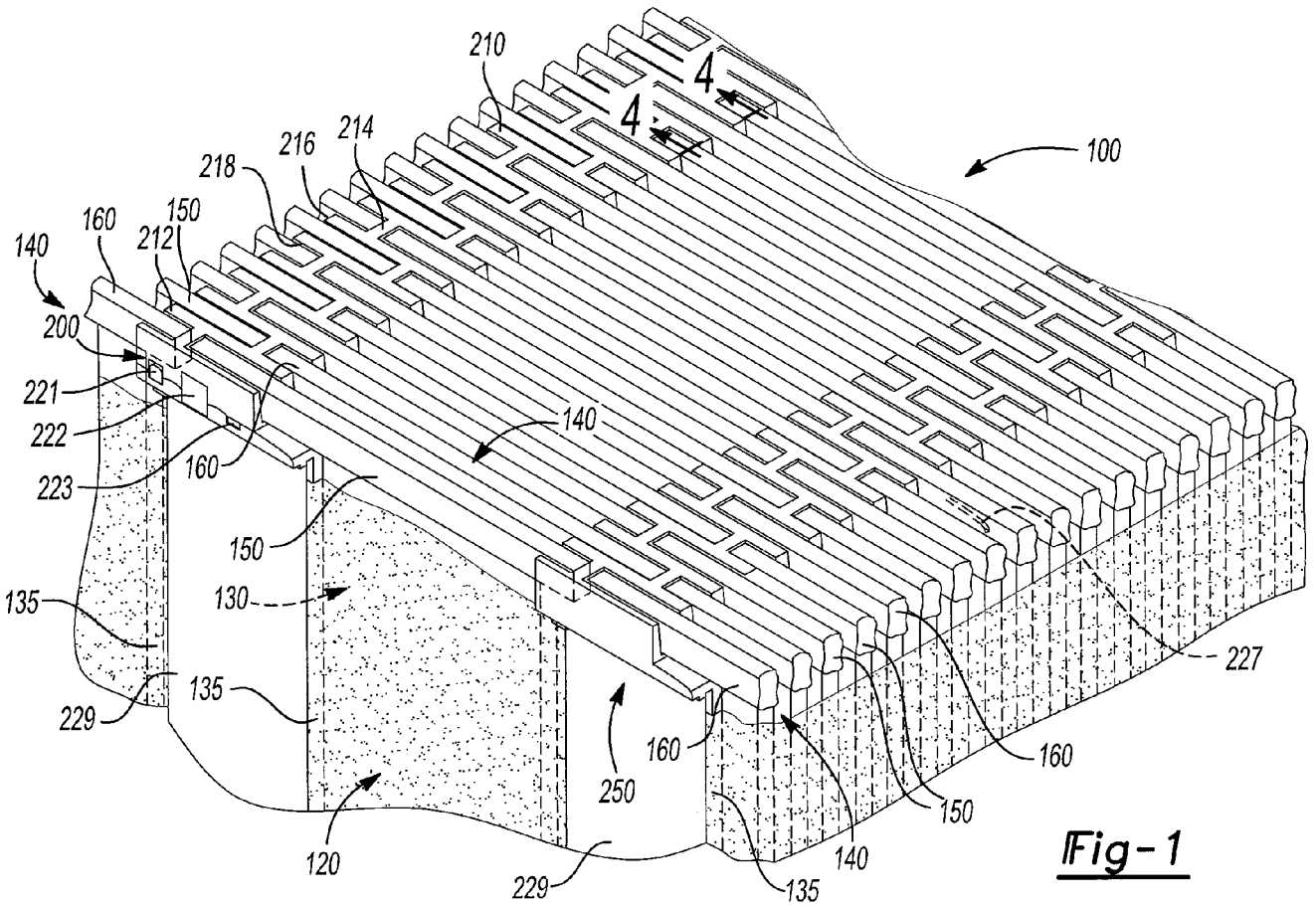
FIG. 1 is a partial perspective view illustrating a first embodiment of a system of electrolytic cells, according to various embodiments.

The following description is merely exemplary in nature and is not intended to limit the present invention, applications, or uses. It should be understood that throughout the drawings, corresponding reference numerals indicate like or corresponding parts and features. The description of specific examples indicated in various embodiments of the present invention are intended for purposes of illustration only and are not intended to limit the scope of the invention disclosed herein. Moreover, recitation of multiple embodiments having stated features is not intended to exclude other embodiments having additional features or other embodiments incorporating different combinations of the stated features.

Various embodiments of the present invention are an improvement to the conventional contact bar for an electrowinning system. For example, the present invention provides a contact bar that is less complex. The present invention can provide an improvement in the efficiency and consistency of the current flow of an electrowinning system. In various embodiments, a contact bar can provide a means of a current flow into two electrolyte cells simultaneously. In various embodiments, the contact bar has a first current source and a plurality of second current sources. In such embodiments, the first current source can be coupled to at least a pair of electrolytic cells and each of the cells can be coupled to one of the plurality of second current sources.

In some embodiments, a method of electrowinning a metal can include the use of a contact bar as described herein. A method of operating of an electrowinning system can include providing a contact bar having a first current source and a plurality of second current sources. The method can also include coupling a plurality of electrowinning cells to the first current source and coupling each of the electrowinning cells to one of the plurality of second current sources. The method can further include electrowinning a metal in the plurality of electrowinning cells.

In an exemplary embodiment, an improvement in a contact bar can include a plurality of first seats and a plurality of second seats operable to secure the extremities of a plurality of electrodes into the contact bar and each of the seats defines a position of each of the plurality of electrodes in a pair of electrolytic cells. In this exemplary embodiment, each of the plurality of first seats share a common wall with one of the plurality of second seats and the first seats have a length of greater than half a width of the contact bar. In yet a further aspect of this exemplary embodiment, the contact bar can include a first current source coupled to the plurality of first seats and each of the plurality of second seats is coupled to one of a plurality of second current sources. In another aspect of this exemplary embodiment, the contact bar is a component of an electrowinning system.

In accordance with various embodiments, the present invention provides an electrolytic cell contact bar or a bus bar having a first pole and a pair of second poles. The second poles are opposite in charge to the first pole and each of the pair of second poles are adjacent to and parallel to the first pole. In an exemplary embodiment, the contact bar includes an electrode holder capable of holding at least one electrode and the holder can include an insulation member capable of electrically separating a plurality of cathodes and anodes. In various embodiments, the contact bar supports the extremities of the plurality of electrodes immersed into two different electrolytic cells and provides current to the cathodes and anodes in the two cells. In an exemplary embodiment, the first pole is coupled to at least one cathode and one of the second poles is coupled to at least one anode. In an alternative exemplary embodiment, the first pole is coupled to at least one anode and one of the second poles is coupled to at least one cathode.

In accordance with various embodiments, the present invention provides a system of electrolytic cells. The system can include a wall shared by a pair of electrolytic cells. In an exemplary embodiment, the system includes a contact bar or bus bar that comprises a first pole that is located on a top portion of the wall and two second poles that are also located on the top portion of the wall, the first pole has the opposite in charge from the second poles. The system can further include at least one conducting plate in each of the pair of electrolytic cells that is seated in the contact bar and coupled to the first pole. The system can include at least a second set of conducting plates in each of the pair of electrolytic cells seated in the contact bar and coupled to at least one of the second poles. In various embodiments, the system can include a power supply coupled to at least one of the poles and a controller that controls a current to the conducting plates. In an exemplary embodiment, the first set of conducting plates is cathodes and the second set of conducting plates is anodes. In an alternative exemplary embodiment, the first set of conducting plates is a set of anodes and the second set of conducting plates is a set of cathodes.

In various embodiments, the present invention provides a method of operating a pair of electrolytic cells. The method can include providing two electrolytic cells having a common wall with a contact bar on top of the wall. The contact bar can include a first contact strip coupled to a first set of conducting members and two second contact strips. Each of the two contact strips in contact with a second set of conducting members and a second set of conducting members are disbursed in both of the electrolytic cells. The method can further include energizing the first contact strip with a charged current energizing the second contact strips with the opposite charged current. In various embodiments, the method can include electrowinning the metal and the metal can be copper. In various embodiments, the method can include controlling the energizing of the first contact strip and the second contact strips to optimize the yield of a refined metal.

The use of the present invention in electrowinning can be advantageous for improved current flow efficiency and/or consistency. The present invention can lower the power draw that is needed to operate a plurality of electrolytic cells in an electrowinning system. In some embodiments of the present invention, the current flow can be controlled more precisely which can improve operating economics and improve metal recovery yields. In some embodiments, the implementation of the present invention lowers the costs of building an electrowinning system and can lower the cost of operation of such a system.

Figure 8:
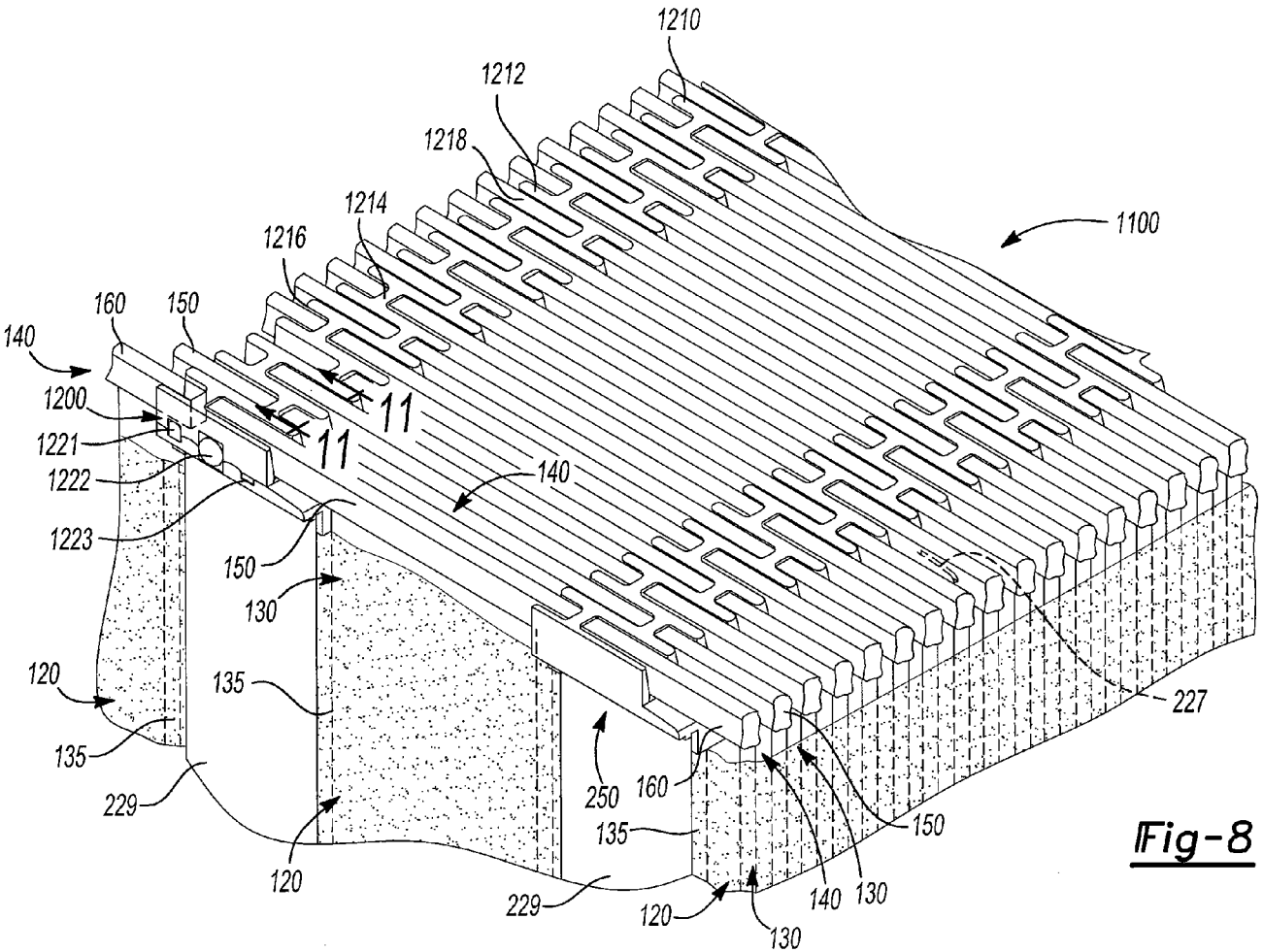
FIG. 8 is a partial perspective view of a second embodiment of a system of electrolytic cells according to various embodiments of the present invention.

FIGS. 1 and 8 illustrate exemplary embodiments of the present invention which is related to an electrolytic cell 120 or to an electrolytic cell system 100. Typically, an electrolytic cell 120 comprises a vessel used to do electrolysis, containing electrolyte solution 135, usually a solution of water or other solvents capable of dissolving various ions into solution, and a first electrode 130 and a second electrode 140, each may be either a cathode or an anode. The electrolyte in the cell 120 is inert unless driven by external voltage into a redox reaction with the anode and cathode.

Commercially, an electrolytic cell system 100 can be used in electrorefining and electrowinning of several non-ferrous metals. In the case of electrowinning, a current is passed from an inert anode through the electrolyte solution 135 containing the metal so that the metal is extracted as it is deposited in an electroplating process onto the cathode. In general, the most common electrowon metals are copper, gold, silver, zinc, nickel, chromium, cobalt, manganese, the rare-earth metals, and alkali metals.

Each of the electrolytic cells 120 comprises a plurality of first electrodes 130 and a plurality of second electrodes 140, both immersed in the electrolyte solution 135. The first electrodes 130 can be one of plurality of cathodes and a plurality of anodes. The second electrodes 140 can be one of plurality of cathodes and a plurality of anodes. If the plurality of first electrodes 130 is a plurality of cathodes then the plurality of second electrodes 140 is a plurality of anodes. Alternatively, if the plurality of first electrodes 130 is a plurality of anodes then the plurality of second electrodes 140 is a plurality of cathodes. The first electrodes 130 are always opposite in electrical charge to the second electrodes 140.

For purposes of this detailed description of various embodiments of the present invention, the term "cathode" refers to a complete electrode assembly to which negative polarity is applied and is typically connected to a single bar but may be connected to a pair of bars. For example, in a cathode assembly comprising multiple thin rods suspended from a hanger bar, the term "cathode" is used to refer to the group of thin rods, and not to a single rod. Furthermore, the term "anode" refers to a complete electrode assembly to which positive polarity is applied and is typically connected to a single bar but may be connected to a pair of bars. For example, in an anode assembly comprising multiple thin rods suspended from a hanger bar, the term "anode" is used to refer to the group of thin rods, and not to a single rod.

In various embodiments of conventional electrowinning operations, such as for example those used in copper purification, use either a copper starter sheet or a stainless steel or titanium "blank" as the cathode in the electrolytic cell 120. In an exemplary embodiment, the cathode in electrolytic cell 120 can be configured to allow flow of electrolyte solution 135 through the cathode. As used herein, the term "flow-through cathode" refers to any cathode configured to enable electrolyte solution 135 to pass through it in the electrolytic cell 120 to flow through the cathode during the electrowinning process.

Various flow-through cathode configurations may be suitable, including: (1) multiple parallel metal wires, thin rods, including hexagonal rods or other geometries, (2) multiple parallel metal strips either aligned with electrolyte flow or inclined at an angle to flow direction, (3) metal mesh, (4) expanded porous metal structure, (5) metal wool or fabric, and/or (6) conductive polymers. The cathode may be formed of copper, copper alloy, stainless steel, titanium, aluminum, or any other metal or combination of metals and/or other materials. Polishing or other surface finishes, surface coatings, surface oxidation layer(s), or any other suitable barrier layer may advantageously be employed to enhance harvestability of a metal, such as for example copper. Alternatively, unpolished or rough surfaces may also be utilized. In accordance with various embodiments of the present invention, the cathode may be configured in any manner now known or hereafter devised by those skilled in the art. Examples of flow-through cathodes useful herein include commonly assigned U.S. Patent Application Publication 20060016684 and U.S. Patent Application Publication 20060016696 to Stevens published Jan. 26, 2006.

In various embodiments of the present invention, an anode can be formed of one of the so-called "valve" metals, including titanium, tantalum, zirconium, or niobium. Where suitable for the process chemistry being utilized in the electrowinning cell, the anode may also be formed of other metals, such as nickel, stainless steel (e.g., Type 316, Type 316L, Type 317, Type 310, etc.), or a metal alloy (e.g., a nickel-chrome alloy), intermetallic mixture, or a ceramic or cermet containing one or more valve metals. For example, titanium may be alloyed with nickel, cobalt, iron, manganese, or copper to form a suitable anode. In accordance with one exemplary embodiment, the anode comprises titanium, because, among other things, titanium is rugged and corrosion-resistant. Titanium anodes, for example, when used in accordance with various embodiments of the present invention, potentially have useful lives of up to fifteen years or more. In an exemplary embodiment, anodes employed in conventional electrowinning operations, such as for example in the purification of copper, typically comprise lead or a lead alloy, such as, for example, Pb—Sn—Ca.

The anode may also optionally comprise any electrochemically active coating. Exemplary coatings include those provided from platinum, ruthenium, iridium, or other Group VIII metals, Group VIII metal oxides, or compounds comprising Group VIII metals, and oxides and compounds of titanium, molybdenum, tantalum, and/or mixtures and combinations thereof. Ruthenium oxide and iridium oxide are two preferred compounds for use as an electrochemically active coating on titanium anodes.

In an exemplary embodiment of the present invention, the anode comprises a titanium mesh (or other metal, metal alloy, intermetallic mixture, or ceramic or cermet as set forth above) upon which a coating comprising carbon, graphite, a mixture of carbon and graphite, a precious metal oxide, or a spinel-type coating is applied. In various embodiments, the anode can comprise a titanium mesh with a coating comprised of a mixture of carbon black powder and graphite powder.

In another exemplary embodiment, the anode comprises a carbon composite or a metal-graphite sintered material. In accordance with other exemplary embodiments of the invention, the anode may be formed of a carbon composite material, graphite rods, graphite-carbon coated metallic mesh and the like. Moreover, a metal in the metallic mesh or metal-graphite sintered material may be titanium; however, any metal may be used without detracting from the scope of the present invention.

In an exemplary embodiment, a wire mesh may be welded to the conductor rods, wherein the wire mesh and conductor rods may comprise materials as described above for anodes. In one exemplary embodiment, the wire mesh comprises a woven wire screen with 80 by 80 strands per square inch, however various mesh configurations may be used, such as for example, 30 by 30 strands per square inch. Moreover, various regular and irregular geometric mesh configurations may be used. In accordance with yet another exemplary embodiment, a flow-through anode may comprise a plurality of vertically-suspended stainless steel rods, or stainless steel rods fitted with graphite tubes or rings. In accordance with another aspect of an exemplary embodiment, the hanger bar to which the anode body is attached comprises copper or a suitably conductive copper alloy, aluminum, or other suitable conductive material.

As used herein, the term "flow-through anode" refers to any anode configured to enable electrolyte to pass through it. While fluid flow from an electrolyte flow manifold provides electrolyte movement, a flow-through anode allows the electrolyte in the electrochemical cell to flow through the anode during the electrowinning process. Any now known or hereafter devised flow-through anode may be utilized in accordance with various aspects of the present invention. Possible configurations include, but are not limited to, metal, metal wool, metal fabric, other suitable conductive nonmetallic materials (e.g., carbon materials), an expanded porous metal structure, metal mesh, expanded metal mesh, corrugated metal mesh, multiple metal strips, multiple metal wires or rods, woven wire cloth, perforated metal sheets, and the like, or combinations thereof. Moreover, suitable anode configurations are not limited to planar configurations, but may include any suitable multiplanar geometric configuration.

With reference to FIG. 1, in various embodiments of the present invention, an electrolytic cell system 100 can comprise multiple electrolytic cells 120 configured in series or otherwise electrically connected, each comprising a series of electrodes 130, 140 alternating as anodes and cathodes. In an exemplary embodiment, each electrolytic cell 120 or portion of an electrolytic cell 120 comprises between about 4 and about 80 anodes and between about 4 and about 80 cathodes. In another exemplary embodiment, each electrolytic cell 120 or portion of an electrolytic cell 120 comprises from about 15 to about 40 anodes and about 16 to about 41 cathodes. However, it should be appreciated that in accordance with the present invention, any number of anodes and/or cathodes may be utilized.

Referring back to FIGS. 1 and 8, each electrolytic cell 120 comprises two walls 229, each of which can be shared with an adjacent electrolytic cell 120 of the electrolytic cell system 100. Since electrolytic cell 120 is illustrated as a portion, it will be appreciated by those skilled in the art that electrolytic cell 120 comprises a front wall (not shown), a rear wall (not shown), and a bottom (also not shown) such that the electrolyte solution 135 is contained in electrolytic cell 120. It will also be appreciated by those skilled in the art that electrolytic cell 120 can comprise electrolyte flow systems, drainage systems, filling systems, and the like including any necessary plumbing, pumps, jets, vacuums, agitators, and the like for such systems. Generally speaking, any electrolyte solution 135, any pumping, circulation, or agitation system capable of maintaining satisfactory flow and circulation of electrolyte solution 135 between the electrodes 130, 140 in an electrolytic cell 120 may be used in accordance with various embodiments of the present invention.

In various embodiments of the present invention, the acid concentration in the electrolyte solution 135 for electrowinning may be maintained at a level of from about 1 to about 500 grams of acid per liter of electrolyte solution 135. In various embodiments, the acid concentration in the electrolyte can be maintained at a level of about 5 to about 250 grams or from about 150 to about 205 grams of acid per liter of electrolyte solution 135, depending upon the upstream process. As known to those skilled in the art, the electrolyte solution 135 can comprise a metal ion that can be electrowon by use of electrolytic cell 120. In an exemplary embodiment, the metal ion is a copper ion.

In various embodiments of the present invention, the temperature of the electrolyte solution 135 in the electrolytic cell 120 is maintained above the freezing point of the electrolyte solution 135 and below the boiling point of the electrolyte solution 135. In accordance with various embodiments, the electrolyte solution 135 is maintained at a temperature of from about 40° F. to about 150° F. or from about 90° F. to about 140° F. Higher temperatures may, however, be advantageously employed. For example, in direct electrowinning operations, temperatures higher than 140° F. may be utilized. Alternatively, in certain applications, lower temperatures may advantageously be employed. For example, when direct electrowinning of dilute copper-containing solutions is desired, temperatures below 85° F. may be utilized.

The operating temperature of the electrolyte solution 135 in the electrolytic cell 120 may be controlled through any one or more of a variety of means well known to those skilled in the art, including, for example, heat exchangers, an immersion heating element, an in-line heating device, or the like, and may be coupled with one or more feedback temperature control means for efficient process control.

Now with reference to FIGS. 1, 4, 5, and 6, first electrode 130 further comprises first hanger bar 150 which is electrically conductive. First hanger bar 150 can comprise any conductive material such as for example copper, aluminum, silver, gold, chromium, and alloys thereof. The conductive material may be metallic or non-metallic such as a polymeric material which may be doped. A non-metallic material that is electrically conductive can be coated onto the first hanger bar 150. First hanger bar 150 is integrated to and can be part of first electrode 130. The first hanger bar 150 is electrically coupled to the first electrode 130. The first hanger bar 150 spans between contact bar 200 (which also may be known as a bus bar) and capping board 250, thus holding first electrode 130 in the electrolytic cell 120 in contact with electrolyte solution 135. In various embodiments, contact bar 200 can be a double contact bar. In various embodiments, the first hanger bar 150 can be coupled to the contact bar 200 in one of a plurality of first seats 218. In various embodiments, capping board 250 may be replaced with a second contact bar 200 which may increase current flow or improve current flow characteristics.

The second electrode 140 further comprises second hanger bar 160 which is electrically conductive. Second hanger bar 160 can comprise any conductive material such as for example copper, aluminum, silver, gold, chromium, and alloys thereof. The conductive material may be metallic or non-metallic such as a polymeric material which may be doped. A non-metallic material that is electrically conductive can be coated onto the second hanger bar 160. The second hanger bar 160 is integrated to and can be part of second electrode 140. The second hanger bar 160 is electrically coupled to second electrode 140. The second hanger bar 160 spans between contact bar 200 and capping board 250, thus holding the second electrode 140 in the electrolytic cell 120 in contact with electrolyte solution 135. In various embodiments, the second hanger bar 160 can be coupled to the contact bar 200 in one of a plurality of second seats 216. As discussed herein, in various embodiments, capping board 250 may be replaced with a second contact bar 200.

Figure 2:
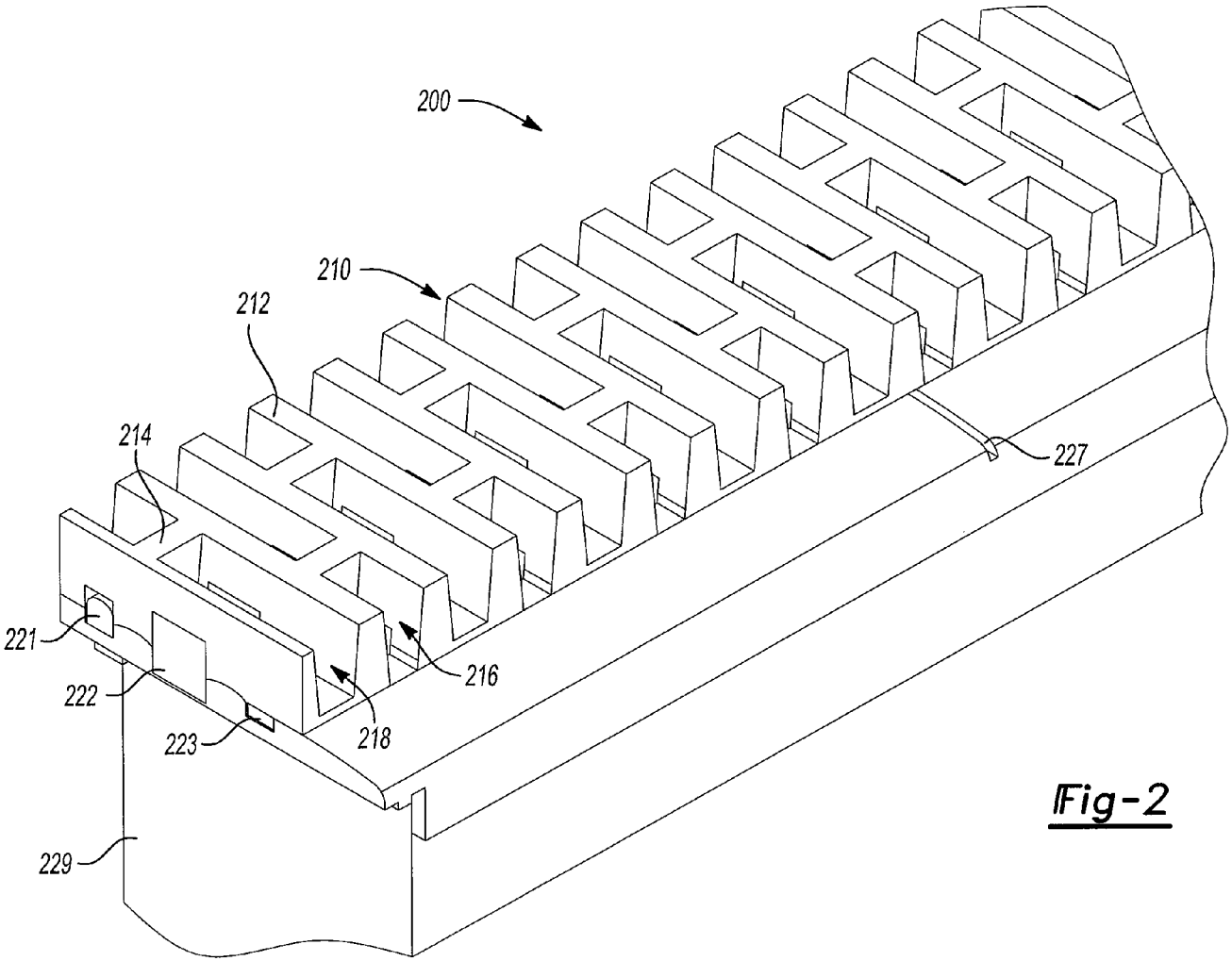
FIG. 2 is a partial perspective view of a first embodiment of a contact bar, according to various embodiments of the present invention.
Figure 3:
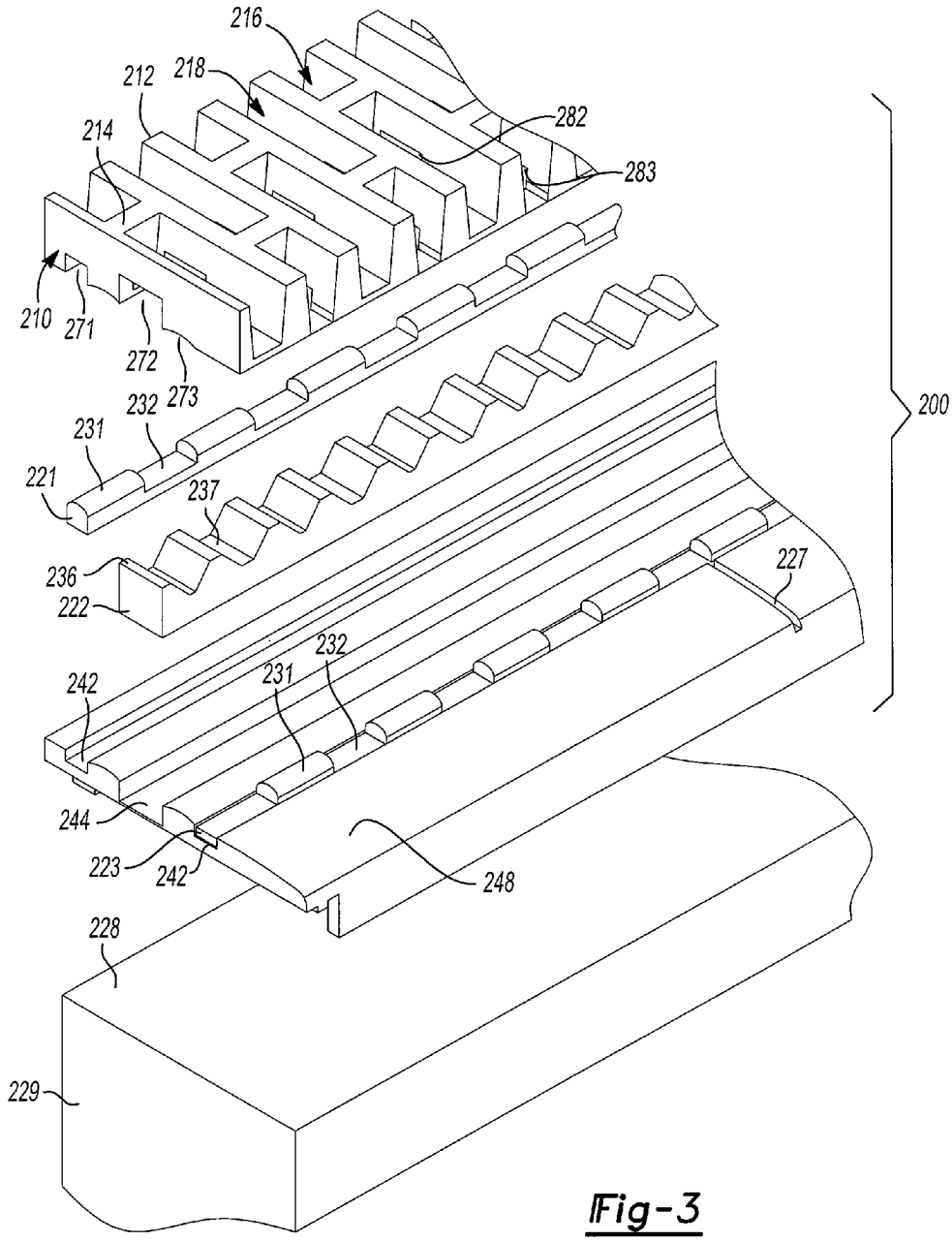
FIG. 3 is a partial fragmentary perspective view of FIG. 2 according to various embodiments of the present invention.
Figure 7:
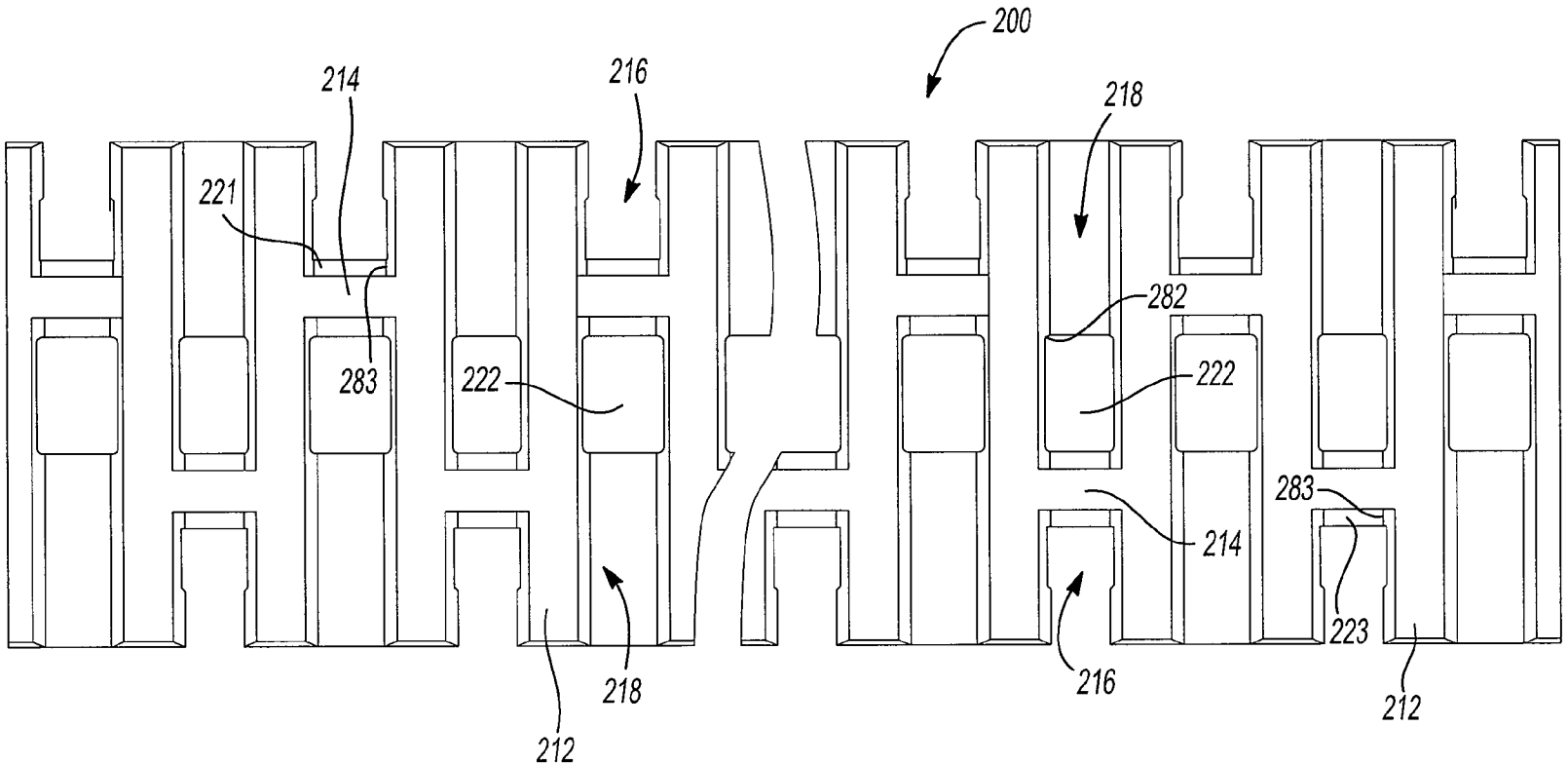
FIG. 7 is a partial top view of the first embodiment of the contact bar, according to various embodiments of the present invention.

With additional reference to FIGS. 2, 3, and 7, contact bar 200 comprises a base plate 248, a first pole 222, a pair of second poles 221, 223, and seating member 210. As used herein the term "pole" refers to an electrically conductive member and may also be known to those skilled in the art as a strip, a contact strip, a power strip, a current strip, a bus, a bar, a power bar, a rod and the like. The base plate 248 is non-conductive. The base plate 248 can comprise any combination of materials that results in non-conductivity and has the strength to hold the weight of a plurality of first electrodes 130 and a plurality of second electrodes 140. The base plate 248 is sized to fit on top of wall 229. The base plate 248 can be fastened to the top of the wall 229 using any method and/or apparatus known to those skilled in the art including but not limited to fasteners, adhesives, coatings, and combinations thereof. The base plate 248 has a first groove 244 that is sized to receive first pole 222 and a pair of second grooves 242 that are sized to receive the second poles 221, 223. The first groove 244 and the pair of second grooves 242 each run along at least a portion of a length of base plate 248. The first groove 244 can be between the pair of second grooves 242 and can run parallel there to. In various embodiments, the base plate 248 can include at least one electrolyte return 227 which operably returns splattered electrolyte solution 135 from the base plate 248 to the electrolytic cell 120. A plurality of electrolyte returns 227 may be spaced along base plate 248.

In various embodiments, a pad 247 can be between the base plate 248 and the top of the wall 229. The pad 247 can assist in insulating the base plate 248 from the wall 229. The pad 247 may insulate the base plate 248 from heat radiated by the wall 229 due to elevated temperatures of the electrolyte 130, may insulate the baseplate 248 from any electrical conductivity of the wall 229 or may insulate the baseplate 248 from both heat and electrical conductivity. In various embodiments, the pad 247 can absorb some of the downward energy generated by the seating of a plurality of first electrodes 130 and second electrodes 140 into the contact bar 200. The pad 247 can comprise for example a polymeric, elastomeric, or neoprene type material. The base plate 248 can be fastened to the pad 247 using any method and/or apparatus known to those skilled in the art including but not limited to fasteners, adhesives, coatings, and combinations thereof.

The seating member 210 is non-conductive and can operably be an insulator between a plurality of first electrodes 130 and a plurality of second electrodes 140. The seating member 210 can comprise any combination of materials that results in non-conductivity and has the strength to hold a plurality of first electrodes 130 and a plurality of second electrodes 140 in place. The seating member is sized to fit over base plate 248 and is fastened to base plate 248 using any method and/or apparatus known to those skilled in the art including but not limited to fasteners, adhesives, coatings, and combinations thereof. The seating member 210 has an upper surface which comprises a plurality of first seats 218 and a plurality of second seats 216. The seating member 210 has a bottom surface which has three notches, a first notch 272 and a pair of second notches 271, 273. The first notch 272 provides an opening 282 in each of the first seat 218. The pair of second notches 271, 273 provides an opening 283 in each of the second seats 216.

Each of the first seats 218 and the second seats 216 are defined by two separators 212, the base plate 248 and a shared seat divider 214. A length of the first seats 218 is greater than a length of the second seats 216. In various embodiments, the length of the first seats 218 is greater that half of a width of the contact bar 200. In various embodiments, the length of the first seats 218 is at least twice the length of the second seats 216. The first seats 218 can be sized to receive any one of the plurality of first electrodes 130. The second seats 216 can sized to receive any one of the plurality of second electrodes 140.

Figure 4:
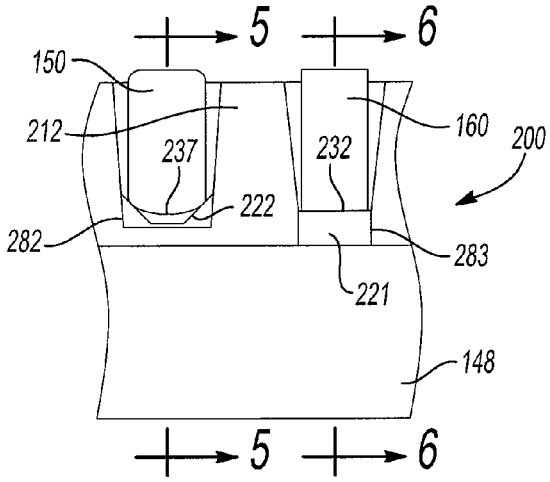
FIG. 4 is a cross-sectional view along the line 4-4 of FIG. 1, according to various embodiments of the present invention.
Figure 5:
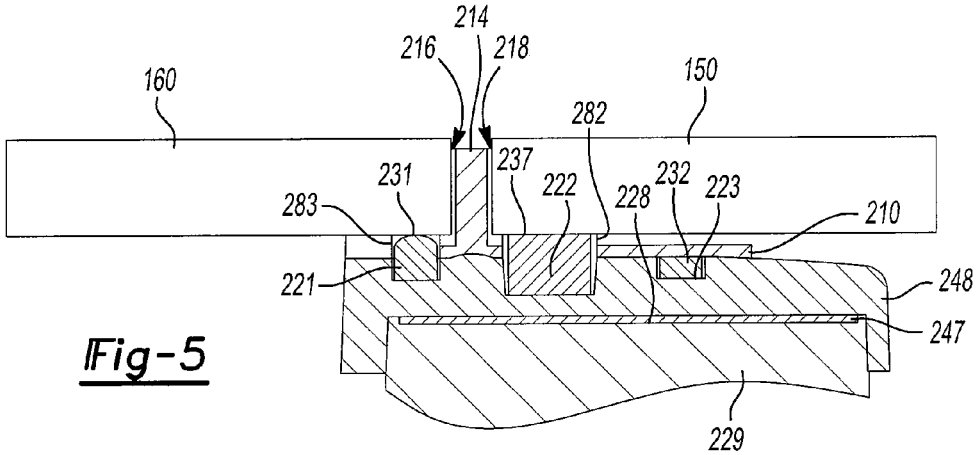
FIG. 5 is a cross-sectional view along the line 5-5 of FIG. 4, according to various embodiments of the present invention.
Figure 6:
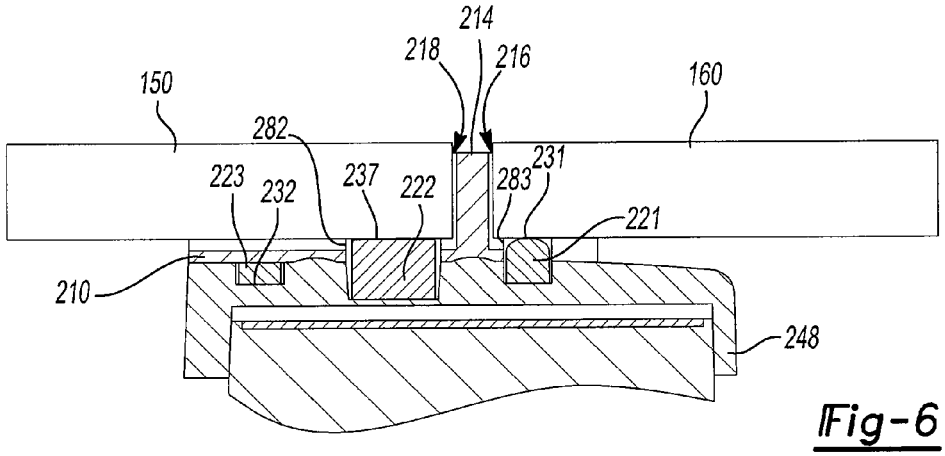
FIG. 6 is a cross-sectional view along the line 6-6 of FIG. 4, according to various embodiments of the present invention.

The contact bar 200 comprises a first pole 222 and a pair of second poles 221, 223. The first pole 222 can be fitted between the first groove 244 and the first notch 272. In various embodiments, the first pole 222 can be shaped to have essentially a saw tooth pattern having a repeating v-notched pattern with a peak 236 and a valley 237. With reference to FIG. 4, a portion of the sloped section of saw toothed pattern and the valley 237 of the first pole 222 is sized to fit through the opening 282 in the first seats 218. The first hanger bar 150 of the first electrode 130 is seated in at least one of the sloped section of saw toothed pattern and the valley 237 of the first pole 222 and is electrically coupled to the first pole 222.

The pair of second poles 221, 223 can be fitted between the second grooves 242 and the pair of second notches 271, 273. In various embodiments, the pair of second poles 221, 223 can be shaped to have essentially a castlellation pattern having a merlon 231 and a flat 232. The merlon 231 can be sized to fit through the opening 283 in second seats 216. The flat 232 positioned below the first seats 218 and is electrically insulated from the first seats 218. The second hanger bar 160 of the second electrode 130 is seated on the merlon 231 and is electrically coupled to one of the second poles 221, 223. The first pole 222 and the pair of second poles 221, 223 are electrically conductive, In various embodiments, the first pole 222 and the pair of second poles 221, 223 can comprise a highly conductive metal, such as for example copper, silver, gold, aluminum, chromium, combinations thereof, alloys thereof, or the like.

The first pole 222 and the pair of second poles 221, 223 are coupled to a power supply which may include a controller. In various embodiments, the power supply provides a positive electrical current to the first pole 222 and a negative electrical current to the pair of second poles 221, 223. In various embodiments, the power supply provides a negative electrical current to the first pole 222 and a positive electrical current to the pair of second poles 221, 223. The plurality of first electrodes 130 are electrically coupled to the first pole 222 and the plurality of second electrodes 140 are electrically coupled to the pair of second poles 221, 223. The power supply provides current to create a current density on an active area of one of the plurality of first electrodes 130 and the plurality of second electrodes 140.

In various embodiments of the present invention, the plurality of first electrodes 130 are cathodes and the plurality of second electrodes 140 are anodes. In various embodiments, the plurality of first electrodes 130 are anodes and the plurality of second electrodes 140 are cathodes. In various embodiments, the controller controls the power supply voltage to provide an optimum current to at least one of the first poles 222 and the pair of second poles 221, 223. The controller can control power supply to provide a desired current density to a plurality of cathodes in electrolytic cell 120. The controller that may be used for such applications are well known to those skilled in the art.

In various embodiments, the current density can be from about 5 A/ft$^2$ of active cathode to about 5000 A/ft$^2$ of active cathode. The term "active cathode" is known to those skilled in the art and refers to the area of the cathode that is in contact with electrolyte solution 135. For example, in the product of copper, the current density can be from about 5 A/ft$^2$ of active cathode to about 500 A/ft$^2$ of active cathode. Generally speaking, as the operating current density in the electrolytic cell 120 increases, the metal plating rate increases. Stated another way, as the operating current density increases, more cathode metal is produced for a given time period and cathode active surface area than when a lower operating current density is achieved. Alternatively, by increasing the operating current density, the same amount of metal may be produced in a given time period, but with less active cathode surface area (i.e., fewer or smaller cathodes, which corresponds to lower capital equipment costs and lower operating costs). The deposition rate of metals onto cathodes can increase with higher current densities. However, depending on the cathode and anode system being used in electrolytic cell 120, excess current may be wasted on converting water to hydrogen and oxygen gas, instead of plating out the desired metal.

With reference to FIG. 8, in various embodiments of the present invention, an electrolytic cell system 1100 can comprise multiple electrolytic cells 120 configured in series or otherwise electrically connected, each comprising a series of electrodes 130, 140 alternating as anodes and cathodes. In an exemplary embodiment, each electrolytic cell 120 or portion of an electrolytic cell 120 comprises between about 4 and about 80 anodes and between about 4 and about 80 cathodes. In another exemplary embodiment, each electrolytic cell 120 or portion of an electrolytic cell 120 comprises from about 15 to about 40 anodes and about 16 to about 41 cathodes. However, it should be appreciated that in accordance with the present invention, any number of anodes and/or cathodes may be utilized.

Now with reference to FIGS. 8, 11, 12, and 13, first electrode 130 further comprises first hanger bar 150 which is electrically conductive, as described herein.

The first hanger bar 150 spans between contact bar 1200 and capping board 250, thus holding first electrode 130 in the electrolytic cell 120 in contact with electrolyte solution 135. In various embodiments, contact bar 1200 can be a double contact bar. In various embodiments, the first hanger bar 150 can be coupled to the contact bar 1200 in one of a plurality of first seats 218. In various embodiments, capping board 250 may be replaced with a second contact bar 1200.

The second electrode 140 further comprises second hanger bar 160 which is electrically conductive, as described herein. The second hanger bar 160 spans between contact bar 1200 and capping board 250, thus holding the second electrode 140 in the electrolytic cell 120 in contact with electrolyte solution 135. In various embodiments, the second hanger bar 160 can be coupled to the contact bar 1200 in one of a plurality of second seats 216.

Figure 9:
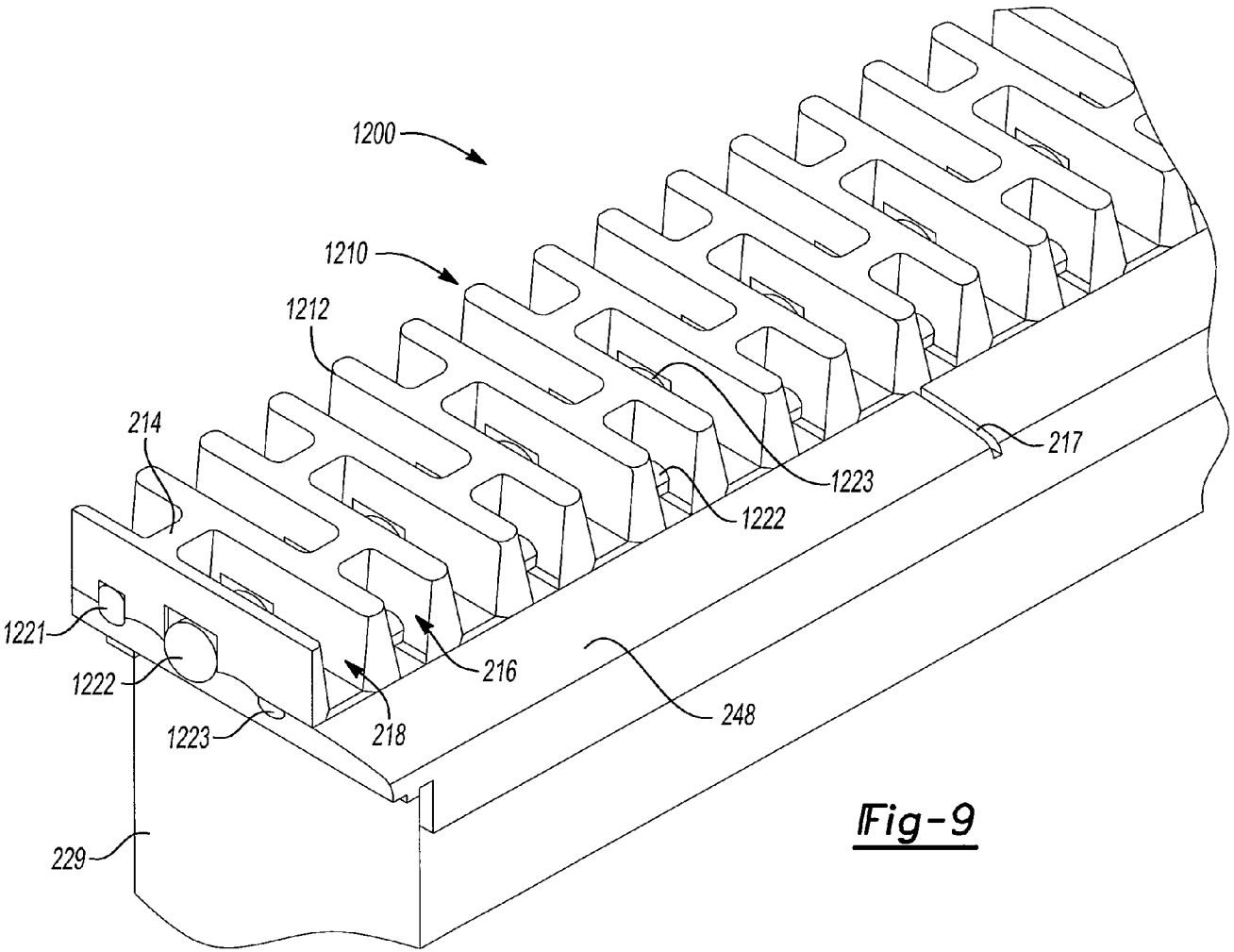
FIG. 9 is a partial perspective view of a second contact bar according to various embodiments of the present invention.
Figure 10:
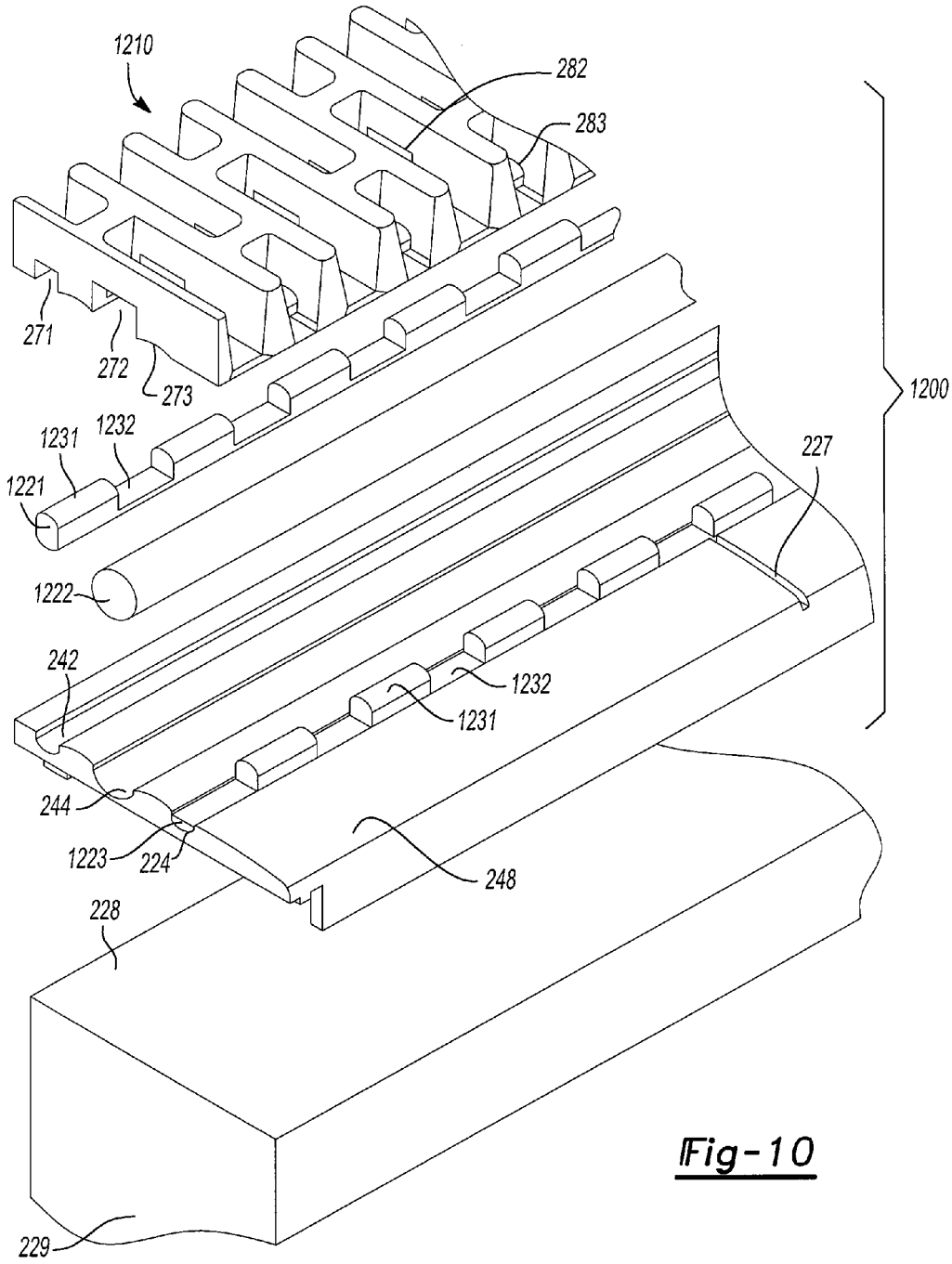
FIG. 10 is a partial fragmentary perspective view of FIG. 9, according to various embodiments of the present invention.
Figure 11:
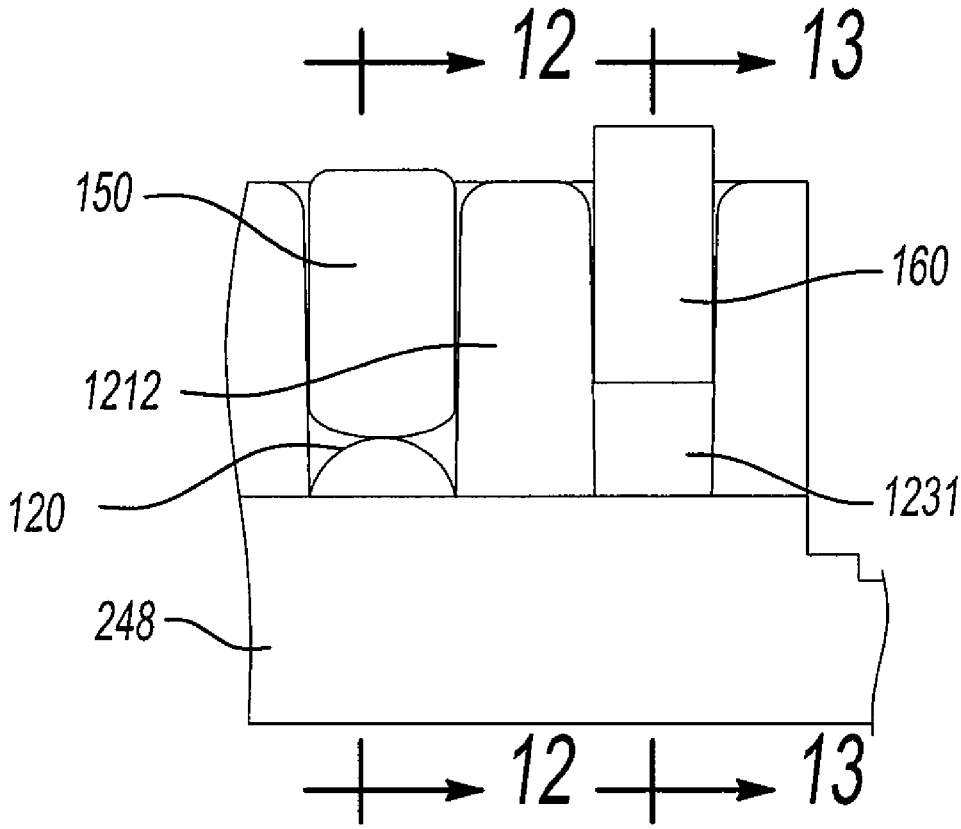
FIG. 11 is a cross-sectional view along the line 4-4 of FIG. 8, according to various embodiments of the present invention.
Figure 12:
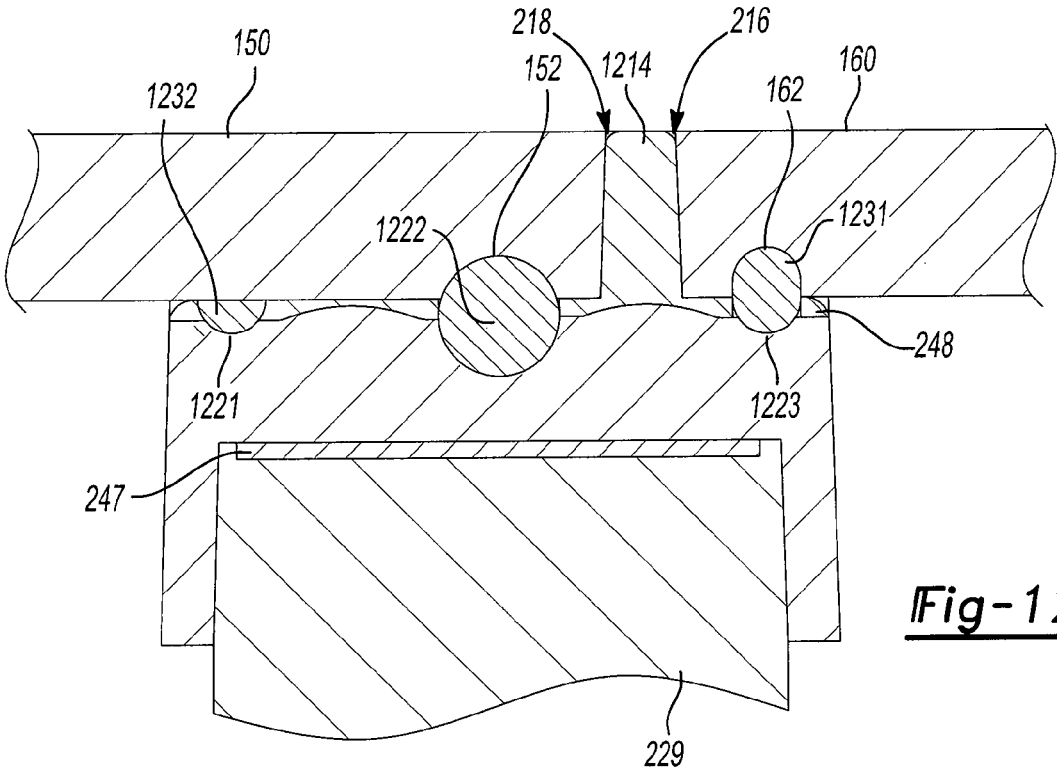
FIG. 12 is a cross-sectional view along the line 12-12 of FIG. 11, according to various embodiments of the present invention.
Figure 13:
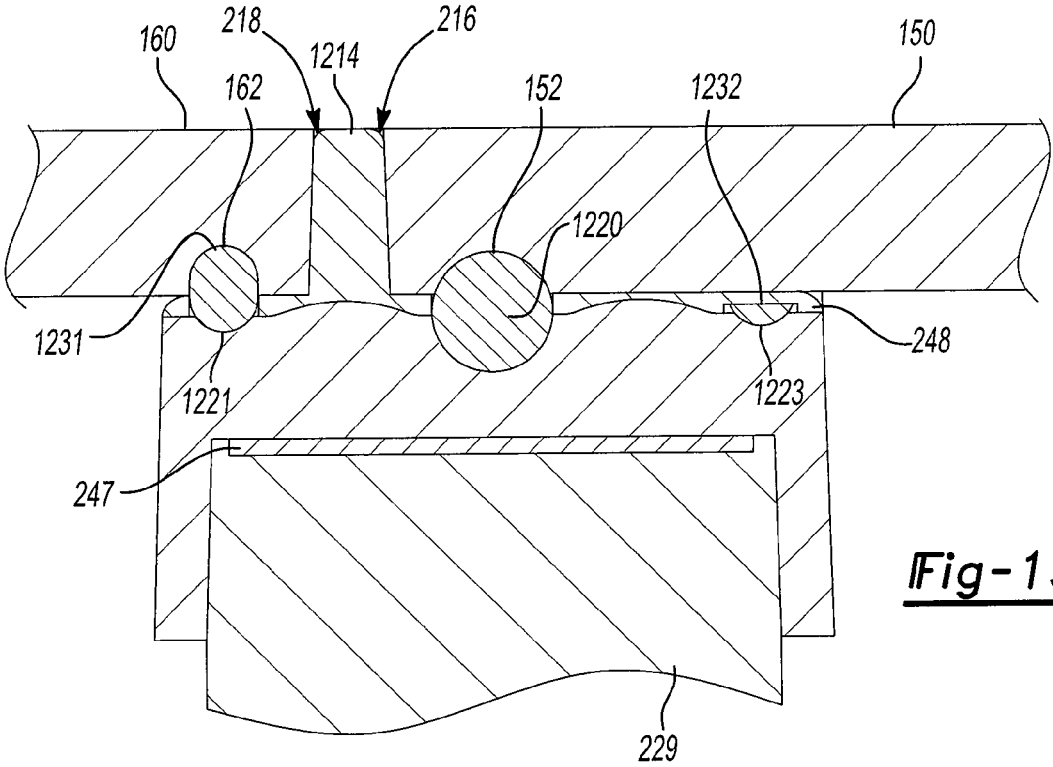
FIG. 13 is a cross-sectional view along the line 13-13 of FIG. 11, according to various embodiments of the present invention.
Figure 14:
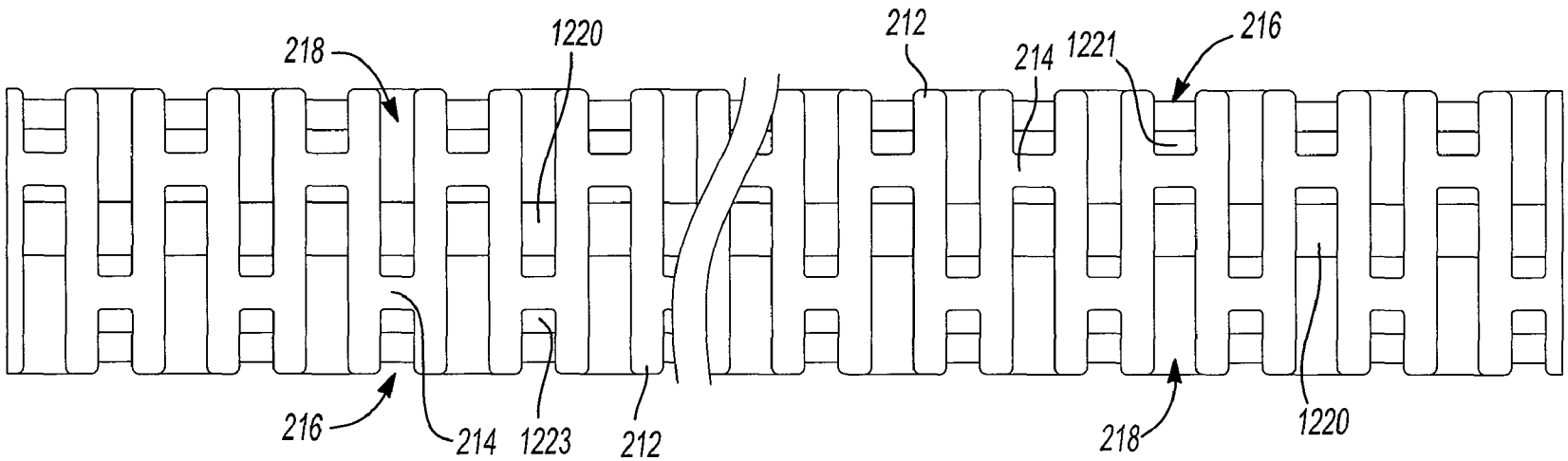
FIG. 14 is a partial top view of the second contact bar according to various embodiments of the present invention.

With additional reference to FIGS. 9, 10, and 14, contact bar 1200 comprises a base plate 248, a first pole 1222, a pair of second poles 1221, 1223, and seating member 1210. The base plate 248 is non-conductive. The base plate 248 can comprise any combination of materials that results in non-conductivity and has the strength to hold the weight of a plurality of first electrodes 130 and a plurality of second electrodes 140. The base plate 248 is sized to fit on top of wall 229. The base plate 248 can be fastened to the top of the wall 229 using any method and/or apparatus known to those skilled in the art including but not limited to fasteners, adhesives, coatings, and combinations thereof. The base plate 248 has a first groove 244 that is sized to receive first pole 1222 and a pair of second grooves 242 that are sized to receive the second poles 1221, 1223. The first groove 244 and the pair of second grooves 242 each run along at least a portion of a length of base plate 248. The first groove 244 can be between the pair of second grooves 242 and can run parallel there to. In various embodiments, the base plate 248 can include at least one electrolyte return 227 which operably returns splattered electrolyte solution 135 from the base plate 248 to the electrolytic cell 120. A plurality of electrolyte returns 227 may be spaced along base plate 248. In various embodiments, a pad 247 can be between the base plate 248 and the top of the wall 229, as described herein.

The seating member 1210 is non-conductive and can operably be an insulator between a plurality of first electrodes 130 and a plurality of second electrodes 140. The seating member 1210 can comprise any combination of materials that results in non-conductivity and has the strength to hold a plurality of first electrodes 130 and a plurality of second electrodes 140 in place. The seating member 1210 is sized to fit over base plate 248 and is fastened to base plate 248 using any method and/or apparatus known to those skilled in the art including but not limited to fasteners, adhesives, coatings, and combinations thereof. The seating member 1210 has an upper surface which comprises a plurality of first seats 218 and a plurality of second seats 216. The seating member 210 has a bottom surface which has three notches, a first notch 272 and a pair of second notches 271, 273. The first notch 272 provides an opening 282 in each of the first seats 218. The pair of second notches 271, 273 provides an opening 283 in each of the second seats 216.

Each of the first seats 218 and the second seats 216 are defined by two separators 1212, the base plate 248 and a shared seat divider 1214. In an exemplary embodiment, each of the two separators 1212 has a curved shape on at least one of its edges. A length of the first seats 218 is greater than a length of the second seats 216. In various embodiments, the length of the first seat 218 is greater than half of a width of the contact bar 1200. In various embodiments, the length of the first seat is at least twice the length of the second seats 216. The first seats 218 can be sized to receive any one of the plurality of first electrodes 130. The second seats 216 can be sized to receive any one of the plurality of second electrodes 140.

The contact bar 1200 comprises a first pole 1222 and a pair of second poles 1221, 1223. The first pole 1222 can be fitted between the first groove 244 and the first notch 272. In various embodiments, the first pole 1222 can be essentially a rod in shape and is sized to fit through the opening 282 in the first seat 218. The first hanger bar 150 of the first electrode 130 is seated on the first pole 1222 and is electrically coupled to the first pole 1222.

The pair of second poles 1221, 1223 can be fitted between the second grooves 242 and the pair of second notches 271, 273. In various embodiments, the pair of second poles 1221, 1223 can be essentially a rod in shape with a saw toothed pattern on a top portion of the rod. The saw tooth pattern on the pair of second poles 1221, 1223 create a peak 1231 and a valley 1232. The peak 1231 can be sized to fit through the opening 283 in second seat 216. The valley 1232 is positioned below the first seat 218 and is electrically insulated from the first seat 218. The second hanger bar 160 of the second electrode 130 is seated on the peak 1231 and is electrically coupled to one of the second poles 1221, 1223.

The first pole 1222 and the pair of second poles 1221, 1223 are electrically conductive, In various embodiments, the first pole 1222 and the pair of second poles 1221, 1223 can comprise a highly conductive metal, such as for example copper, sliver, gold, aluminum, chromium, combinations thereof, alloys thereof, or the like.

The first pole 1222 and the pair of second poles 1221, 1223 are coupled to a power supply which may include a controller. In various embodiments, the power supply provides a positive electrical current to the first pole 1222 and a negative electrical current to the pair of second poles 1221, 1223. In various embodiments, the power supply provides a negative electrical current to the first pole 1222 and a positive electrical current to the pair of second poles 1221, 1223. The plurality of first electrodes 130 are electrically coupled to the first pole 1222 and the plurality of second electrodes 140 are electrically coupled to the pair of second poles 1221, 1223. In various embodiments, the first hanger bar 150 is seated in one of the first seats 218 and is coupled to the first pole 1222. In various embodiments, the second hanger bar 160 is seated in one of the second seats 216 and coupled to one of the pair of second poles 1221, 1223. The power supply provides current to create a current density on an active area of one of the plurality of first electrodes 130 and the plurality of second electrodes 140.

In various embodiments of the present invention, the plurality of first electrodes 130 are cathodes and the plurality of second electrodes 140 are anodes. In various embodiments, the plurality of first electrodes 130 are anodes and the plurality of second electrodes 140 are cathodes. The controller controls the power supply voltage to provide an optimum current to at least one of the first poles 1222 and the pair of second poles 1221, 1223. The controller can control power supply to provide a desired current density to a plurality of cathodes in electrolytic cell 120. Controller that may be used for such applications are well known to those skilled in the art.

In various embodiments, the present invention provides a method of operating a pair of electrolytic cells 120. The method can include providing two electrolytic cells 120 having a common wall 229 with a contact bar 200, or 1200 on top of the wall 229. The contact bar 200 or 1200 can include a first contact strip or first pole 222 or 1222 coupled to a first set of conducting members or first electrodes 130 and two second contact strips or second poles 221, 223, or 1221, 1223. Each of the two second poles 221, 223, or 1221, 1223 can be in contact with a second set of conducting members or second electrodes 140 and the second set of electrodes 140 are disbursed in both of the electrolytic cells 120. The method can further include energizing the first pole 222 or 1222 with a charged current and energizing the pair of second poles 221, 223, or 1221, 1223 with an opposite charged current. In various embodiments, the method can include electrowinning a metal and the metal can be copper. In various embodiments, the method can include controlling the energizing of the first pole 222 or 1222 and the second poles 221, 223, or 1221, 1223 to optimize the yield of a refined metal.

The following non-limiting examples may be useful to those skilled in the art for the application of copper electrowinning using electrolytic cell system 100.

Example 1

Conventional Copper Electrowinning

In accordance with an exemplary embodiment of the present invention, conventional copper electrowinning, wherein copper is plated from an impure anode to a substantially pure cathode with an aqueous electrolyte, occurs by the following reactions:

Cathode Reaction:

$$Cu^{2+}+SO_4^{2-}+2e^-\rightarrow Cu^0+SO_4^{2}\ (E^0=+0.345\ V)$$

Anode Reaction:

$$H2O\rightarrow ½O2+2H++2e-\ (E0=-1.230\ V)$$

Overall Cell Reaction:

$$Cu^{2+}+SO_4^{2-}+H_2O\rightarrow Cu^0+2H^++SO_4^{2-}+½O_2\ (E^0=-0.855\ V)$$

The conventional copper electrowinning chemistry and electrowinning apparatus are known in the art. Conventional electrowinning operations typically operate at current densities in the range of about 20 to about 35 A/ft$^2$ active cathode, and more typically between about 28 and about 32 A/ft$^2$. Using additional electrolyte circulation and/or air injection into the cell allows higher current densities to be achieved.

Example 2

Alternative Copper Electrowinning

In accordance with another exemplary embodiment of the present invention, an alternative copper electrowinning process that reduces the energy requirement for copper electrowinning is to use the ferrous/ferric anode reaction, which occurs by the following reactions:

Cathode Reaction:

$$Cu^{2+}+SO_4^{2-}+2e^-\rightarrow Cu^0+SO_4^{2-}\ (E^0=+0.345\ V)$$

Anode Reaction:

$$2Fe^{2+}\rightarrow 2Fe^{3+}+2e^-(E^0=-0.770\ V)$$

Overall Cell Reaction:

$$Cu^{2+}+SO_4^{2-}+2Fe^{2+}\rightarrow Cu^0+2Fe^{3+}+SO_4^{2-}\ (E^0=-0.425\ V)$$

The ferric iron generated at the anode as a result of this overall cell reaction can be reduced back to ferrous iron using sulfur dioxide, as follows:

Solution Reaction:

$$2Fe^{3+}\rightarrow SO_2^{-}+2H_2O\rightarrow 2Fe^{2+}+4H^++SO_4^{2-}$$

This exemplary embodiment can provide a copper electrowinning system that, by utilizing the ferrous/ferric anode reaction it enables significant enhancement in electrowinning efficiency, energy consumption, and reduction of acid mist generation as compared to conventional copper electrowinning processes and previous attempts to apply the ferrous/ferric anode reaction to copper electrowinning operations.

The use of the ferrous/ferric anode reaction in copper electrowinning cells lowers the energy consumption of those cells as compared to conventional copper electrowinning cells that employ the decomposition of water anode reaction, since the oxidation of ferrous iron ($Fe^{2+}$) to ferric iron ($Fe^{3+}$) occurs at a lower voltage than does the decomposition of water. However, maximum voltage reduction—and thus maximum energy reduction—cannot occur using the ferrous/ferric anode reaction unless effective transport of ferrous iron and ferric iron to and from, respectively, the cell anode(s) is achieved. This is because the oxidation of ferrous iron to ferric iron in a copper electrolyte is a diffusion-controlled reaction.

An exemplary embodiment may include the use of a flow-through anode which enables the efficient and cost-effective operation of a copper electrowinning system employing the ferrous/ferric anode reaction at a total cell voltage of less than about 1.5 V and at current densities of greater than about 100 A/ft$^2$ of active cathode and reduces acid mist generation. This example can include the coupling of the flow-through anode with an effective electrolyte circulation system. Furthermore, the use of such a system permits the use of low ferrous iron concentrations and optimized electrolyte flow rates while producing high quality, commercially saleable product (i.e., LME Grade A copper cathode or equivalent).

Further examples of the ferrous/ferric anode reaction, include but are limited to U.S. Pat. No. 5,492,608, to Sandoval issued Feb. 20, 1996; U.S. Patent Application Publication 20050269209 to Sandoval published Dec. 8, 2005; and U.S. Patent Application Publication 20060226024 to Sandoval published Oct. 12, 2006.

Example 3

Copper Powder Production by Electrowinning

In accordance with another exemplary embodiment of the present invention, a process for producing copper powder includes the steps of (i) electrowinning copper powder from a copper-containing solution to produce a slurry stream containing copper powder particles and electrolyte solution 135; (ii) optionally, separating at least a portion of the electrolyte from the copper powder particles in the slurry stream; (iii) optionally, separating one or more coarse copper powder particle size distributions in the slurry stream from one or more finer copper powder particle size distributions in the slurry stream in one or more size classification stages; (iv) conditioning the slurry stream to adjust the pH level of the stream and to stabilize the copper powder particles; (v) optionally, removing the bulk of the liquid from the copper powder particles; (vi) optionally, drying the copper powder particles originally present in the slurry stream to produce a dry copper powder stream; (vii) optionally, separating one or more coarse copper powder particle size distributions in the dry copper powder stream from one or more finer copper powder particle size distributions in the dry copper powder stream in one or more size classification stages; and (viii) either collecting the copper powder final product from the process or subjecting the copper powder stream to further processing.

The process and apparatus for electrowinning copper powder from a copper-containing solution are configured to optimize copper powder particle size and/or size distribution, to optimize cell operating voltage, cell current density, and overall power requirements, to maximize the ease of harvesting copper powder from the cathode, and/or to optimize copper concentration in the lean electrolyte solution 135 stream leaving the electrowinning operation.

The operating current density of the electrolytic cell 120 affects the morphology of the copper powder product and directly affects the production rate of copper powder within the electrolytic cell 120. In general, higher current density decreases the bulk density and particle size of the copper powder and increases surface area of the copper powder, while lower current density increases the bulk density of copper product. For example, the production rate of copper powder by an electrolytic cell 120 is approximately proportional to the current applied to that cell operating at, say, 100 A/ft$^2$ of active cathode produces approximately five times as much copper powder in a given time as a cell operating at 20 A/ft$^2$ of active cathode, all other operating conditions, including active cathode area, remaining constant. The currentcarrying capacity of the cell furniture is, however, one limiting factor. Also, when operating an electrowinning cell at a high current density, the electrolyte solution 135 flow rate through the electrolytic cell 120 may need to be adjusted so as not to deplete the available copper in the electrolyte solution 135 for electrowinning. Moreover, an electrolytic cell 120 operating at a high current density may have a higher power demand than a cell operating at a low current density, and as such, economics also plays a role in the choice of operating parameters and optimization of a particular process.

Examples of metals powder production by electrowinning include but are not limited to U.S. Patent Application Publication 20050269209 to Sandoval published Dec. 8, 2005, U.S. Patent Application Publication 20060016684 to Marsden published Jan. 26, 2006, and U.S. Patent Application Publication 20060016697 to Gilbert published Jan. 26, 2006.

The citation of references herein does not constitute admission that those references are prior art or have relevance to the patentability of the invention disclosed herein. All references cited in the Description section of the specification are hereby incorporated by reference in their entirety for all purposes. In the event that one or more of the incorporated references, literature, and similar materials differs from or contradicts this application, including, but not limited to, defined terms, term usage, described techniques, or the like, this application controls.

Various embodiments and the examples described herein are exemplary and not intended to be limiting in describing the full scope of compositions and methods of these invention. Equivalent changes, modifications and variations of various embodiments, materials, compositions and methods can be made within the scope of the present invention, with substantially similar results.

What is claimed is:

1. A system of electrolytic cells, the system comprising:

a wall shared by a pair of electrolytic cells;

a first pole located on a top portion of said wall;

two second poles located on a top portion of said wall, said first pole opposite in charge from said second poles; and a contact bar on top of said wall, said contact bar operably coupled to said first pole and said second poles;

at least one first conducting plate in each of said electrolytic cells, said first conducting plate held in said contact bar and operably coupled to said first pole; and at least one second conducting plate in each of said electrolytic cells, said second conducting plate held by said contact bar, said second conducting plate in one of said pair of electrolytic cells operably coupled to one of said second poles, and said second conducting plate in the other of said pair of electrolytic cells operably coupled to the other of said second poles.

2. The system according to claim 1 further comprising a power supply coupled to at least one of said first pole and said second poles.

3. The system according to claim 1 further comprising controller operably controlling a current to said poles.

4. The system according to claim 1, wherein said first conducting plate is a cathode and said second conducting plate is an anode.

5. The system according to claim 1, wherein said first conducting plate is an anode and said second conducting plate is a cathode.

6. A contact bar for supporting the extremities of a plurality of electrodes immersed into two electrolytic cells, the contact bar comprising:

a first charged strip running along a portion of a length of said contact bar;

a pair of second charged strips adjacent to and parallel to said first charged strip;

a plurality of first seats and a plurality of second seats operably securing the extremities of the plurality of electrodes into said contact bar and defining a position of each of the plurality of electrodes in the electrolytic cells;

wherein said first seats and said second seats sharing a common wall; and wherein said first seats having a length of greater than half a width of said contact bar.

7. The contact bar according to claim 6 further comprising a plurality of first seats and a plurality of second seats operably securing the extremities of the plurality of electrodes into said contact bar and defining a position of each of the plurality of electrodes in the electrolytic cells.

8. The contact bar according to claim 7, wherein said first seats and said second seats sharing a common wall and wherein said first seats having a length of greater than half a width of said contact bar.

9. The contact bar according to claim 6 further comprising a first coupling point comprising a portion of said first charged strip extending into at least one of said first seats, said first coupling point operably electrically coupling one of the plurality of electrodes to said first charged strip.

10. The contact bar according to claim 6 further comprising a second coupling point comprising a portion of one of said pair of second charged strips extending into at least one of said second seats, said second coupling point operably electrically coupling one of the plurality of electrodes to one of said pair of second charged strips.

11. A method of operating a pair of electrolytic cells, the method comprising:

providing two electrolytic cells having a common wall and a contact bar on top of said wall, said contact bar comprising a first contact strip coupled to a first plurality of conducting members and comprising two second contact strips, a first of said second contact strips coupled to a second plurality of conducing members in a first of said two electrolytic cells and a second of said second contact strips coupled to a third plurality of conducting members in a second of said two electrolytic cells;

energizing said first contact strip with a charged current; and energizing said second contact strips with an opposite charged current.

12. The method according to claim 11 further comprising electrowinning a metal.

13. The method according to claim 12, wherein the metal is copper.

14. The method according to claim 11 further comprising controlling said energizing at least one of said first contact strip and said second contact strips to optimize a yield of a refined metal.

15. The method according to claim 11, wherein said charged current is positive and said opposite charged current is negative.

16. The method according to claim 11, wherein said charged current is negative and said opposite charged current is positive.

17. An improvement to a contact bar for an electrolytic cell useful for electrowinning a metal, the improvement comprising:

a plurality of first seats and a plurality of second seats operably securing the extremities of a plurality of electrodes into the contact bar and defining a position of each of the plurality of electrodes in a pair of electrolytic cells, said first seats and said second seats sharing a common wall and said first seats having a length of greater than half a width of the contact bar.

18. The improvement according to claim 17 further comprising a first charged strip running along a portion of a length of the contact bar and between of a pair of second charged strips, said first charged strip opposite in charge to said pair of second charged strips.

19. The improvement according to claim 17 comprising a plurality of first coupling points comprising a portion of said first charged strip extending into at least a portion of said first seats, said first plurality of coupling points operably electrically coupling a first portion the plurality of electrodes to said first charged strip.

20. The improvement according to claim 17 further comprising a second plurality of coupling points comprising a portion of one of said pair of second charged strips extending into said plurality of said second seats, said plurality of second coupling points operably electrically coupling a second portion of the plurality of electrodes to one of said pair of second charged strips.

* * * * *